US010288284B2

(12) United States Patent
Lee et al.

(10) Patent No.: US 10,288,284 B2
(45) Date of Patent: May 14, 2019

(54) APPARATUS FOR COLLECTING LARGE PARTICLE ASH IN THERMAL POWER PLANT

(71) Applicant: DOOSAN HEAVY INDUSTRIES & CONSTRUCTION CO., LTD., Changwon-si, Gyeongsangnam-do (KR)

(72) Inventors: Sang Rin Lee, Changwon-si (KR); Jae Min Hwang, Yeongwol-gun (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 554 days.

(21) Appl. No.: 15/059,585

(22) Filed: Mar. 3, 2016

(65) Prior Publication Data

US 2016/0320055 A1 Nov. 3, 2016

(30) Foreign Application Priority Data

Mar. 6, 2015 (KR) ..... 10-2015-0031325

(51) Int. Cl.
*F23J 3/04* (2006.01)
*F23J 15/02* (2006.01)

(52) U.S. Cl.
CPC ..... *F23J 15/022* (2013.01); *F23J 3/04* (2013.01); *F23J 2217/20* (2013.01); *F23J 2700/001* (2013.01)

(58) Field of Classification Search
CPC ..... F23J 15/022; F23J 3/04; F23J 2700/001; F23J 2217/20; B01D 45/08
See application file for complete search history.

(56) References Cited

U.S. PATENT DOCUMENTS

| | | | | |
|---|---|---|---|---|
| 4,097,381 | A | 6/1978 | Ritzier | |
| 2005/0150439 | A1 | 7/2005 | Ryan | |
| 2008/0028935 | A1* | 2/2008 | Andersson | B01D 45/04 95/272 |
| 2011/0048234 | A1 | 3/2011 | Iannacchione | |

FOREIGN PATENT DOCUMENTS

| | | | |
|---|---|---|---|
| EP | 1142627 | A1 | 10/2001 |
| FR | 2 342 100 | A1 | 9/1977 |
| JP | H01-129548 | U | 9/1989 |

(Continued)

OTHER PUBLICATIONS

Communication dated May 3, 2016, from Korean Intellectual Property Office in counterpart application No. 10-2015-0031325.

(Continued)

*Primary Examiner* — David J Laux
(74) *Attorney, Agent, or Firm* — Invenstone Patent, LLC

(57) ABSTRACT

An apparatus for collecting large particles, such as large particle ash generated during combustion in the thermal power plant, includes a main duct installed between an inlet duct extending in a first direction and an outlet duct extending in a second direction, and connected to the inlet duct and the outlet duct, a hopper installed in a lower portion of the main duct to collect large particles, and a flow switching section installed in the main duct in order to increase large particle collection efficiency by switching a flow direction of gas introduced from the inlet duct.

7 Claims, 17 Drawing Sheets
(5 of 17 Drawing Sheet(s) Filed in Color)

(56) References Cited

FOREIGN PATENT DOCUMENTS

| | | | |
|---|---|---|---|
| JP | H0295415 | A | 4/1990 |
| JP | 2013-199979 | A | 10/2013 |
| KR | 10-2007-0017208 | A | 2/2007 |
| KR | 10-2013-0035709 | A | 4/2013 |
| WO | 2005/114053 | A1 | 12/2005 |
| WO | 2013/073393 | A1 | 5/2013 |

OTHER PUBLICATIONS

Communication dated Aug. 10, 2016 issued by the European Patent Office in counterpart application No. 16000074.1.

* cited by examiner

APPARATUS FOR COLLECTING LARGE PARTICLE ASH IN THERMAL POWER PLANT

CROSS-REFERENCE TO RELATED APPLICATIONS

This application claims priority to Korean Patent Application No. 10-2015-0031325, filed on Mar. 6, 2015, the disclosure of which is incorporated herein by reference in its entirety.

BACKGROUND

Field

Exemplary embodiments of the present disclosure relate to an apparatus for collecting large particle ash, and more particularly, to an apparatus for collecting large particles (large particle ash) generated during combustion in a thermal power plant.

Description of the Related Art

In general, a large quantity of gas containing environmentally harmful substances is generated during the combustion of coal fuel in thermal power plants, and such combustion gas contains dust particles called "fly ash". Some of fly ash generated during combustion grows to have a large grain size by cohesion, and becomes large particles. The size of large particles is typically 100 μm to 150 μm, but may increase to 150 mm according to a mixed combustion ratio and a boiler temperature.

Large particle ash is generated during combustion and float in an aerosol form in the state in which it is contained in combustion gas. Such characteristics of aerosol have been currently studied in many research institutions. Large particles having a size equal to or greater than 10 μm do not properly follow the movement of fluids. Such motion characteristics of aerosol are affected by inertia according to the size for each particle, and the inertia is proportional to the square of the diameter of the particle. Therefore, the more increased the size of the particle is, the more increased the inertia applied thereto is in proportion to the square of the size.

Thermal power plants ought to purify flue gas containing harmful substances such as large particle ash before it is discharged to the atmosphere in order to reduce the discharge of environmentally harmful substances. Various methods for purifying flue gas depending on the characteristics of contaminants have been developed. Large fly ash may be removed by electrostatic precipitators (ESPs), fabric filters (FFs), or wet scrubbers.

However, if the above large fly ash is collected through hoppers before it is removed by the electrostatic precipitators, the efficiency of devices such as electrostatic precipitators may be increased or the devices may be replaced.

PRIOR ART DOCUMENT (Patent document 1) U.S. Pat.No. 5,375,538

SUMMARY

An object of the present disclosure is to provide an apparatus for collecting large particle ash in a thermal power plant, in which toxic ingredients in exhaust gas discharged to the atmosphere can be effectively reduced by an increase in efficiency for collecting large particles (large particle ash) generated during combustion in a thermal power plant.

Other objects and advantages of the present disclosure can be understood by the following description, and become apparent with reference to the embodiments. Also, it is obvious to those skilled in the art to which the present disclosure pertains that the objects and advantages can be realized by the means as claimed and combinations thereof.

In accordance with one aspect, an apparatus for collecting large particles (large particle ash) generated during combustion in a thermal power plant includes a main duct installed between an inlet duct extending in a first direction and an outlet duct extending in a second direction, and connected to the inlet duct and the outlet duct, a hopper installed in a lower portion of the main duct to collect the large particles, and a flow switching section installed in the main duct in order to increase large particle collection efficiency by switching a flow direction of gas introduced from the inlet duct.

The inlet duct may be connected to a gas-air preheater, and the outlet duct may be connected to a gas-gas heater.

The flow switching section may have a plate shape, and be installed in an upper or lower portion of the main duct.

The flow switching section may be installed at a connection portion between the main duct and an upper or lower side of the outlet duct, so as to be inclined toward the inside of the main duct with respect to the first direction.

The flow switching section may be installed in the main duct so as to be parallel with the first direction and be perpendicular to the second direction.

The flow switching section may be spaced apart from a connection portion between the main duct and the outlet duct in the second direction.

The flow switching section may be connected to and supported by a plurality of support plates fixed to the upper portion of the main duct.

The flow switching section may include a flow switching plate having a plate shape, and a rotary means for rotating the flow switching plate in a first rotational direction.

The flow switching plate may include a shaft for allowing the flow switching plate to rotate in the first rotational direction, and the rotary means may be a motor for rotating the shaft.

The flow switching section may have a plate shape, and be configured such that areas thereof differ from each other according to impact distribution of the large particles.

A plate-shaped floating plate for floating the large particles flowing through the outlet duct may be provided in the outlet duct.

The floating plate may be configured as two or more floating plates provided in the outlet duct, and at least two of the floating plates may be installed at different heights.

In accordance with another aspect, an apparatus for collecting large particles (large particle ash) generated during combustion in a thermal power plant includes a first duct extending in a first direction, a second duct extending in a second direction different from the first direction, a connection duct installed between the first and second ducts, and connected to the first and second ducts, and a side hopper installed in the connection duct to collect large particles contained in gas flowing from the first duct to the second duct.

The connection duct may have a shape that is bent from the first direction to the second direction.

The side hopper may have an opening portion communicating with the first duct, be installed in a lower portion of the connection duct, have a box shape and extend from the first duct, and have an inclined lower portion.

The side hopper may have a height of 1 m.

The side hopper may include an extension duct communicating with the first duct, and a collection section connected to the extension duct and having a funnel shape.

The extension duct may have an inclined lower portion in order to increase large particle collection efficiency.

The extension duct may have a height of 1 m.

It is to be understood that both the foregoing general description and the following detailed description of the present disclosure are exemplary and explanatory and are intended to provide further explanation of the claims.

BRIEF DESCRIPTION OF THE DRAWINGS

The patent or application file contains at least one drawing executed in color. Copies of this patent or patent application publication with color drawings will be provided by the Office upon request and payment of the necessary fee. The above and other objects, features and other advantages of the present disclosure will be more clearly understood from the following detailed description taken in conjunction with the accompanying drawings, in which.

DESCRIPTION OF SPECIFIC EMBODIMENTS

Exemplary embodiments will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope to those skilled in the art. In certain embodiments, description irrelevant to the present disclosure may be omitted to avoid obscuring appreciation of the disclosure.

The present disclosure relates to an apparatus for collecting large particle ash, and includes a first embodiment in which large particles may be collected through a main hopper provided to a main duct, and a second embodiment in which large particles may be collected through a side hopper provided to a connection duct. Throughout the disclosure, the same reference numbers are used to refer to the same or like parts in the first and second embodiments, and detailed description thereof will be omitted.

First, an apparatus for collecting large particle ash according to a first embodiment will be described in detail with reference to FIGS. 1 to 12.

Figure 1:
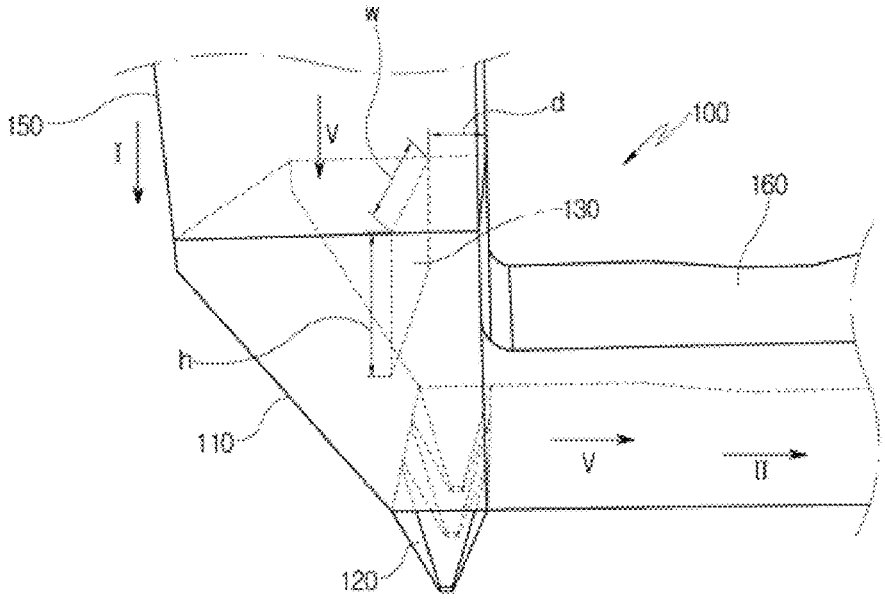
FIG. 1 is a view schematically illustrating an apparatus for collecting large particle ash according to a first embodiment.

Referring to FIG. 1, the apparatus for collecting large particle ash, which is designated by reference numeral 100, according to the first embodiment is provided to collect large particles (large particle ash) generated during combustion in a thermal power plant. The apparatus for collecting large particle ash 100 includes a main duct 110, a hopper 120, and a flow switching section 130. The apparatus for collecting large particle ash 100 is provided, for example, between a gas-air preheater and a gas-gas heater in an overall thermal power plant system. The apparatus for collecting large particle ash 100 may collect large particles contained in combustion gas when the combustion gas burned in the boiler of the thermal power plant passes between the gas-air preheater and the gas-gas heater.

One cross-section of the main duct 110 is formed in a trapezoidal box shape, and the main duct 110 is installed between an inlet duct 150 extending in a first direction and an outlet duct 160 extending in a second direction. In the illustrated embodiment, both of the inlet duct 150 and the outlet duct 160 have a quadrangular cross-section. The inlet duct 150 is connected to the gas-air preheater, and the outlet duct 160 is connected to the gas-gas heater. In the embodiment, the inlet duct 150 and the outlet duct 160 may be almost vertically disposed.

The hopper 120 is provided to collect the large particles, and may be configured as a plurality of hoppers arranged in the lower portion of the main duct 110. Each hopper 120 has a quadrangular funnel shape. The hopper 120 collects the large particles contained in the combustion gas introduced through the inlet duct 150, and prevents the large particles from being discharged to the outlet duct 160.

The flow switching section 130 serves to switch the flow direction of the combustion gas introduced from the inlet duct 150 in order to increase large particle collection efficiency in the hopper 120. In the embodiment, the flow switching section 130 has a rectangular plate shape as a whole, and is installed in the main duct 110 so as to be parallel with the first direction and be almost perpendicular to the second direction. The flow switching section 130 may be fastened to the upper portion in the main duct 110 by welding or bolting. In addition, the flow switching section 130 is spaced apart from a connection point between the main duct 110 and the outlet duct 160 in the second direction.

Since the main duct 110 has a trapezoidal cross-sectional shape and the outlet duct 160 extends in the second direction, the combustion gas introduced into the main duct 110 through the inlet duct 150 is switched from the first direction to the second direction. In the embodiment, the switching angle of the gas in the main duct 110 may be 90° . In this case, the gas switched in the second direction and the large particles contained in the gas strike the plate-shaped flow switching section 130, and are directed toward the hopper 120 installed in the lower portion of the main duct 110. The height (h) and width (w) of the plate-shaped flow switching section 130 may be properly changed according to the shapes and extension directions of the inlet duct 150 and the outlet duct 160 and the flow rate of the introduced combustion gas. The distance (d1) by which the flow switching section 130 is spaced apart from the connection point between the main duct 110 and the outlet duct 160 may be properly adjusted in order to increase an amount of large particles striking the flow switching section 130 according to the flow rate of the introduced combustion gas. In the embodiment, the distance (d1) may be 500 mm.

The large particles switched toward the hopper 120 by the flow switching section 130 are collected in the hopper 120, but are not discharged to the outlet duct 160. Thus, harmful substances contained in the combustion gas discharged to the outlet duct 160 are reduced, and the overall purification efficiency of the thermal power plant may be increased. In addition, since the amount of large particles, which are moved to an electrostatic precipitator (ESP; not shown) via the outlet duct 160, is rapidly reduced, an electrostatic precipitator having a smaller capacity may be used or the above electrostatic precipitator may be replaced.

Hereinafter, only differences between the embodiment illustrated in FIG. 2 and the embodiment illustrated in FIG. 1 will be described.

Figure 2:
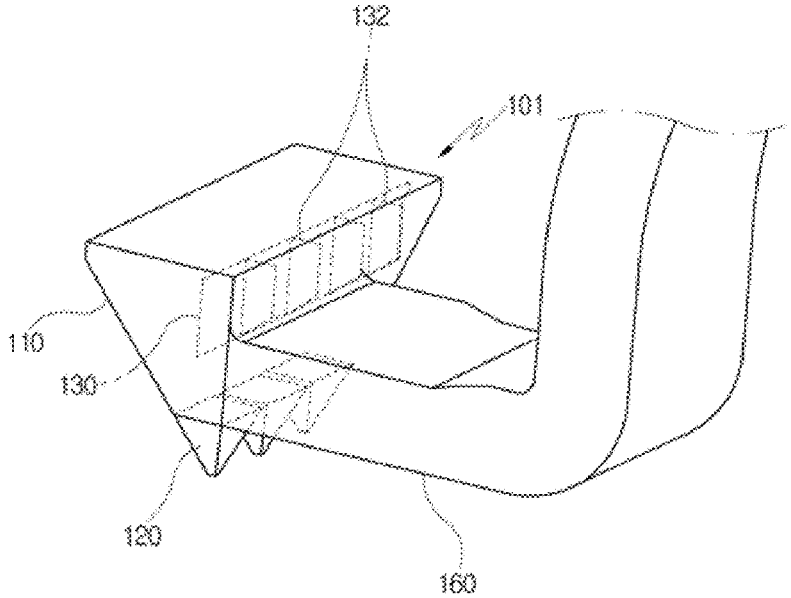
FIG. 2 schematically illustrates an apparatus for collecting large particle ash, in addition to the apparatus in FIG. 1.
Figure 3:
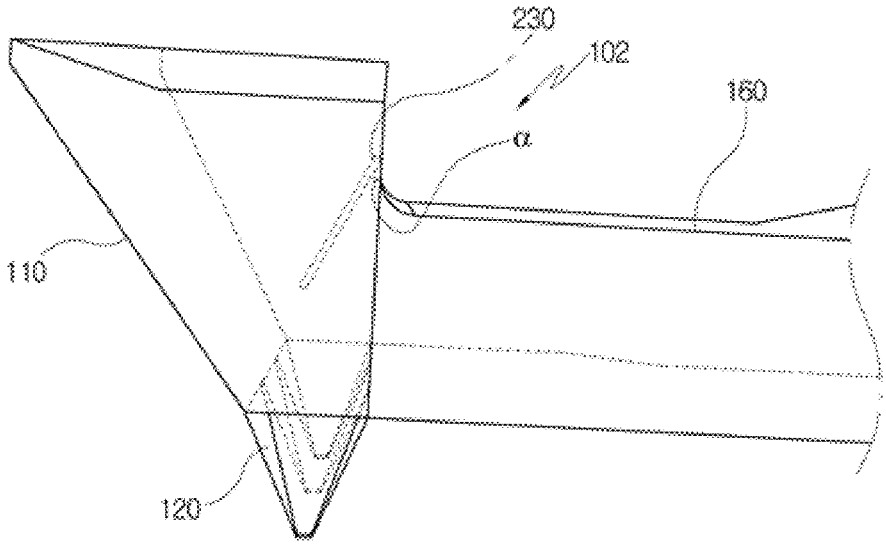
FIG. 3 schematically illustrates another apparatus for collecting large particle ash.

Referring to FIG. 2, an apparatus for collecting large particle ash 101 illustrated in the drawing is provided to collect large particles (large particle ash) generated during combustion in a thermal power plant. A plurality of support plates 132 is additionally provided in the apparatus for collecting large particle ash 100 illustrated in FIG. 1.

The support plates 132 are provided to support the rectangular plate-shaped flow switching section 130. In the embodiment, each of the support plates 132 has a trapezoidal cross-sectional shape, and the support plates 132 are parallel with each other. All of the support plates 132 may be fixed to the plate-shaped flow switching section 130 by bolting or welding. Meanwhile, all of the support plates 132 may be fixed to the upper wall of the main duct 110. Although the flow velocity of combustion gas introduced into the inlet duct 150 is fast and the amount of large particles striking the flow switching section 130 is increased, the flow switching section 130 may be stably supported without damage since it is reinforced by the support plates 132.

Meanwhile, the above embodiments illustratively describe that the plate-shaped flow switching section 130 is parallel with the first direction and is perpendicular to the second direction. However, as in an apparatus for collecting large particle ash 102 illustrated in FIG. 3, a plate-shaped flow switching section 230 may be installed at a connection portion between the main duct 110 and the upper side of the outlet duct 160. In addition, the flow switching section 230 may be installed so as to be inclined toward the inside of the main duct 110 by a predetermined angle ($\alpha$) with respect to the first direction. In this case, the predetermined angle ($\alpha$) may be set such that large particle collection efficiency in the hopper 120 is maximum according to the respective shapes and extension directions of the inlet duct 150 and the outlet duct 160 and the flow rate of the introduced combustion gas.

Figure 4:
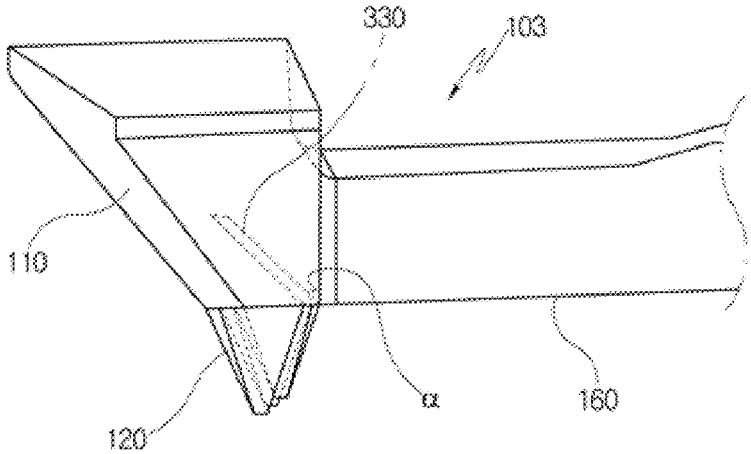
FIG. 4 schematically illustrates another apparatus for collecting large particle ash.

Meanwhile, as in an apparatus for collecting large particle ash 103 illustrated in FIG. 4, a plate-shaped flow switching section 330 may be installed at a connection portion between the main duct 110 and the lower side of the outlet duct 160. In addition, the flow switching section 330 may be installed so as to be inclined toward the inside of the main duct 110 by a predetermined angle ($\alpha$) with respect to the first direction. In this case, the predetermined angle ($\alpha$) may be set such that large particle collection efficiency in the hopper 120 is maximum according to the respective shapes and extension directions of the inlet duct 150 and the outlet duct 160 and the flow rate of the introduced combustion gas. In the apparatus for collecting large particle ash 103, large particles are biased toward the lower portion of the duct and are moved to the outlet duct 160. Therefore, the flow switching section 330 is installed in the connection portion, thereby enabling the large particles to strike the flow switching section 330 and return back to the hopper 120.

Figure 5:
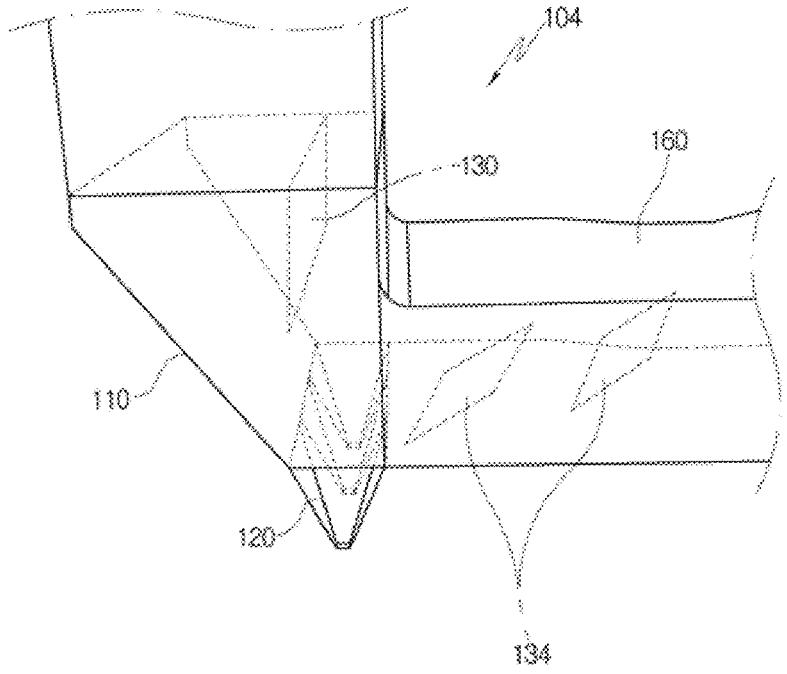
FIG. 5 schematically illustrates another apparatus for collecting large particle ash.

Referring to FIG. 5, an apparatus for collecting large particle ash 104 illustrated in the drawing is provided to collect large particles (large particle ash) generated during combustion in a thermal power plant. The apparatus for collecting large particle ash 104 is similar to that illustrated in FIG. 1 in that the plate-shaped flow switching section 130 is provided in the apparatus for collecting large particle ash 104. A plurality of floating plates 134 for floating large particles is additionally provided in the apparatus for collecting large particle ash 104.

In the illustrated embodiment, all of the floating plates 134 are installed in the outlet duct 160. The floating plates 134 prevents large particles, which are not collected in the hopper 120 but flow to the outlet duct 160, from remaining at a specific portion of the lower portion of the outlet duct 160. The floating plates 134 float large particles such that they are uniformly distributed in the outlet duct 160, in order for the large particles to be collected or purified by an additional collection device or an electrostatic precipitator which is provided behind the outlet duct 160. In the illustrated embodiment, the floating plates 134 may be installed at positions that exhibit an optimal floating effect according to the size of large particles. In the embodiment, two or more floating plates 134 may be provided in the outlet duct 160. At least two of the floating plates 134 may be installed at different heights.

Figure 6:
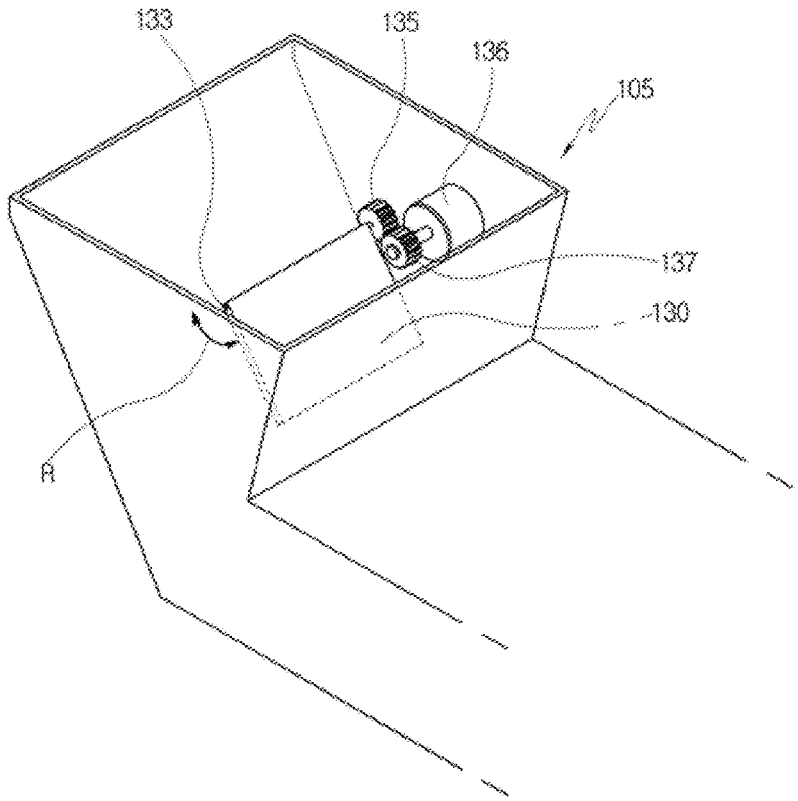
FIG. 6 schematically illustrates another apparatus for collecting large particle ash.

Referring to FIG. 6, an apparatus for collecting large particle ash 105 illustrated in the drawing has a structure in which only a flow switching section differs from that illustrated in FIG. 1 and other configurations are similar to those illustrated in FIG. 1. In the embodiment, the flow switching section includes a plate-shaped flow switching plate 130 and a rotary means for rotating the flow switching plate 130 in a first rotational direction (R). In the embodiment, the rotary means may include a motor 136 and a shaft 133.

The flow switching plate 130 has a rectangular plate shape as illustrated in FIG. 1. The elongated shaft 133 as the center of rotation is fixed to one end of the flow switching plate 130. In addition, a first gear 135 is mounted to one side of the shaft 133. Meanwhile, a second gear 137 engaged with the first gear 135 is mounted to the rotary shaft of the motor 136. When the second gear 137 is rotated by the rotation of the motor 136, the first gear 135 engaged with the second gear 137 is also rotated. Thus, the flow switching plate 130 rotates about the shaft 133 in the first rotational direction (R).

The flow switching plate 130 may be installed at an optimal angle according to the flow rate of combustion gas introduced into the inlet duct 150 and the size of large particles, in order for large particles striking the flow switching plate 130 to be significantly collected in the hopper 120. Accordingly, in order to maximize large particle collection efficiency in the embodiment, the flow switching plate 130 may be rotated at a proper angle by the motor 136, in consideration of various conditions including the flow rate of combustion gas and the size of large particles in the thermal power plant. The present embodiment illustratively describes that the motor 136 and the shaft 133 as the rotary means are operatively connected to the first and second gears 135 and 137. However, the shaft 133 may be directly connected to the motor 136 without using the first and second gears 135 and 137.

Figure 7:
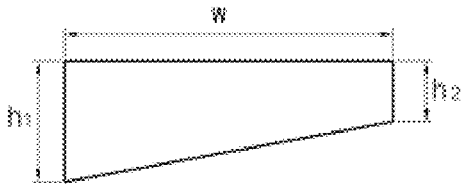
FIGS. 7(*a*), 7(*b*) and 7(*c*) illustrate various flow switching section configurations.
Figure 7:
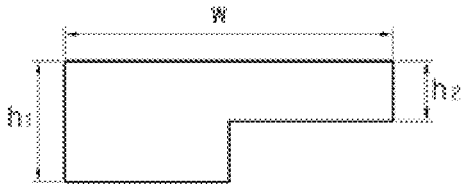
Figure 7:
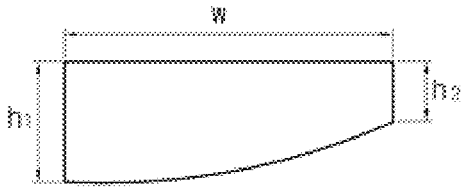

The above embodiments illustratively describe that the flow switching section 130 has a rectangular plate shape. However, the flow switching section 130 may have various plate shapes configured such that areas thereof differ from each other according to the impact distribution of large particles, as illustrated in FIGS. 7(*a*) , 7(*b*) and 7(*c*). For example, the flow switching section 130 may have a trapezoidal shape having a width (w) and first and second sides (h1 and h2) as illustrated in FIG. 7(*a*), or may have a shape in which two rectangles are interconnected as illustrated in FIG. 7(*b*). In addition, the flow switching section 130 may have a shape in which first and second sides (h1 and h2) are straight lines and one side connecting them is a curve, as illustrated in FIG. 7(*c*).

Hereinafter, the effect of the apparatus for collecting large particle ash according to the embodiment will be described with reference to FIGS. 8 to 12.

Figure 8:
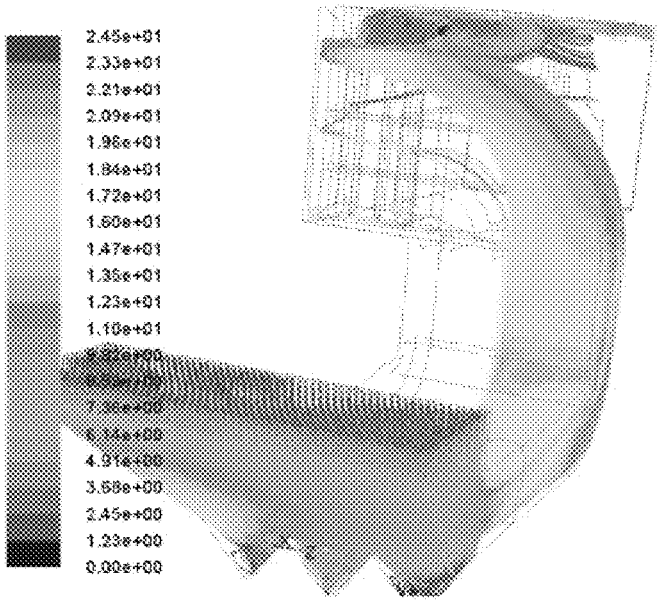
FIG. 8 is a diagram for explaining the flow path of large particles when a flow switching section is not included in the apparatuses for collecting large particle ash.

First, FIG. 8 is a diagram for explaining the flow path of large particles when the flow switching section is not included in the apparatuses for collecting large particle ash. As illustrated in the drawing, large particles having a large size of about 120 μm are biased only toward the right of the duct by inertia, and are biased only upward by one rotation. In addition, the large particles are biased only toward the upper end of the gas-gas heater installed behind the duct. This is because the particles are struck at a speed of 6 m/s to 8 m/s while being not decreased to the speed of exhaust gas. Such a phenomenon occurs because the large particles are not sufficiently decelerated due to the short length of a tube enlarged to the gas-gas heater compared to a case where a relaxation time for large particles is long. As a result, the fin tube of the upper end of the gas-gas heater may be eroded. Here, the relaxation time may be calculated by the following Equation 1:

$$\tau = \frac{\rho_p d^2 C}{18\eta} \quad \text{[Equation 1]}$$

where $\rho_p$ is a particle density, d is a particle diameter, $\eta$ is an air viscosity, and C is a Cunningham correction factor (the Cunningham correction factor being 1 in large particles).

The time required to adapt particles to completely changed circumstances is 3 $\tau$, and is indicated by the following Table 1. The time required to adapt particles having a size of 100 mm to variation in flow velocity is about 0.09 seconds.

TABLE 1

| Particle diameter (mm) | 3 × Relaxation time |
|---|---|
| 0.01 | $2.1 \times 10^{-8}$ |
| 0.1 | $2.7 \times 10^{-7}$ |
| 1.0 | $1.0 \times 10^{-5}$ |
| 10.0 | $9.3 \times 10^{-4}$ |
| 100 | $9.1 \times 10^{-2}$ |

Figure 9:
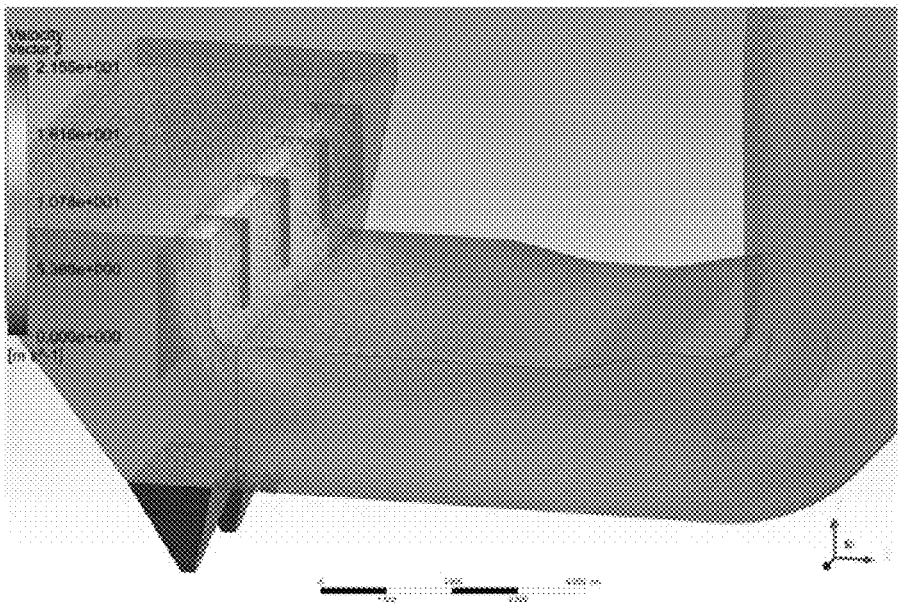
FIG. 9 is a diagram for explaining a velocity vector when the flow switching section is included in the apparatus for collecting large particle ash in FIG. 1.
Figure 10:
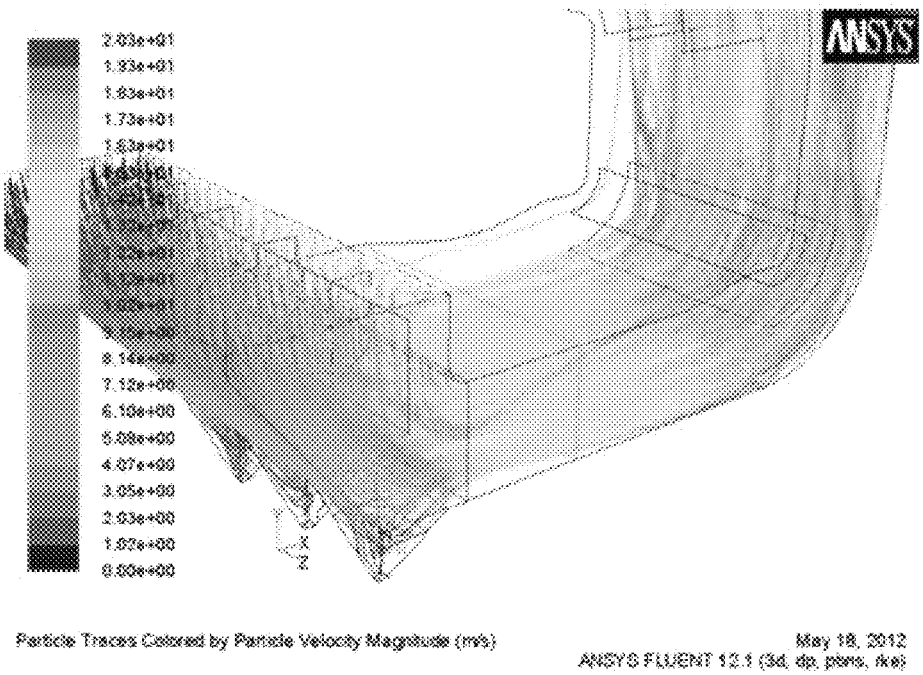
FIG. 10 is a diagram for explaining the flow path of large particles having a size of 50 μm in FIG. 9.
Figure 11:
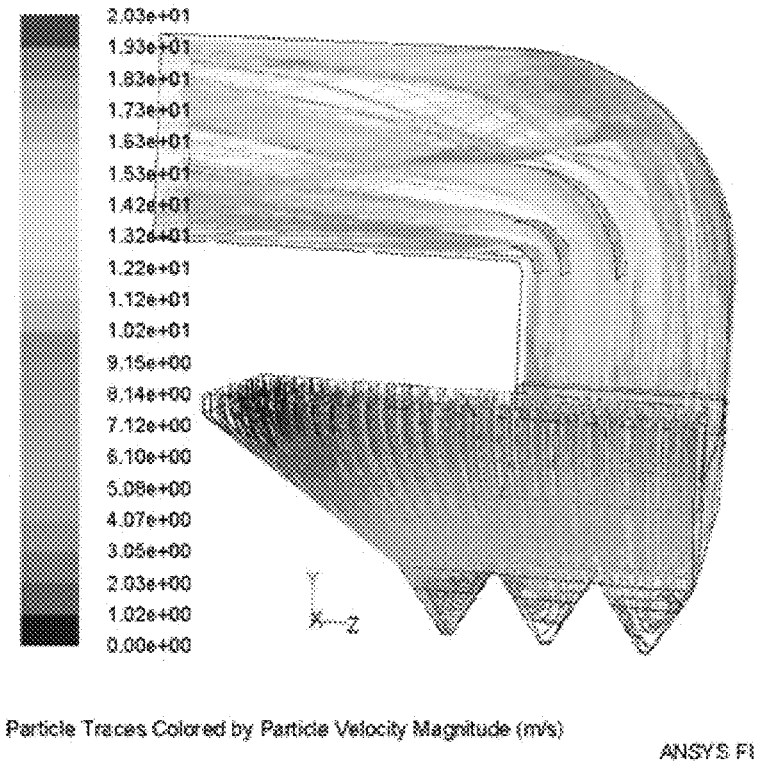
FIG. 11 is a diagram for explaining the flow path of large particles having a size of 50 μm in FIG. 9.
Figure 12:
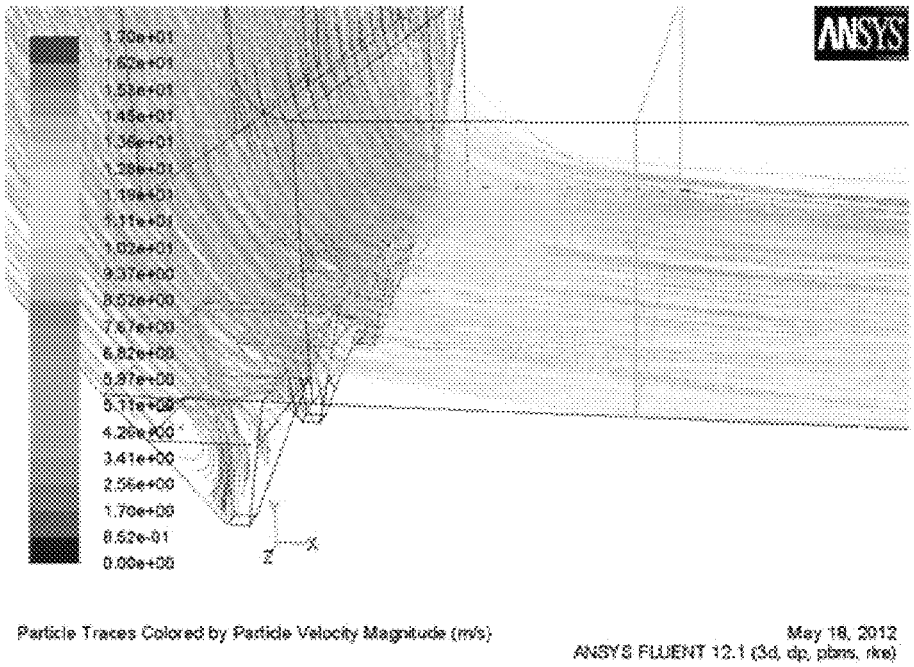
FIG. 12 is a diagram for explaining the flow path of large particles having a size of 100 μm in FIG. 9.

FIG. 9 illustrates the result obtained by modeling and numerically analyzing the embodiment illustrated in FIG. 2. FIGS. 10 and 11 are diagrams for explaining the flow path of large particles having a size of 50 μm in FIG. 9. FIG. 12 is a diagram for explaining the flow path of large particles having a size of 100 μm in FIG. 9.

Referring to FIG. 9, it may be seen that, since exhaust gas is classified according to sectors by the plurality of support plates and the cross-sectional area of the flow path is reduced, the flow velocity of particles is further accelerated when the particles pass through the support plates. Referring to FIGS. 10 and 11, it may be seen that the ratio of large particles, having a small size of 50 μm, striking the hopper is increased, and the large particles are more uniformly distributed while passing through the outlet duct. That is, it is possible to prevent the erosion of the duct by preventing the large particles from being concentrated on only the upper end of the duct.

FIG. 12 illustrates that most of large particles having a size of 100 μm strike the hopper located at the lower end of the duct. Thus, large particle collection efficiency in the hopper is increased.

The following Table 2 indicates large particle collection efficiency in the hopper when the flow switching section is provided and when it is not provided in the embodiment illustrated in FIG. 2. As indicated in Table 2, when the flow switching section is provided in the apparatus, the large particle collection efficiency in the hopper is increased in both large particles having a size of 100 μm and a size of 150 μm.

TABLE 2

Large particle collection efficiency in the hopper according to whether or not the flow switching section is provided

| Particle size | Flow switching section being not provided | Flow switching section being provided in the embodiment |
|---|---|---|
| 100 μm | 47% | 59% |
| 150 μm | 72% | 81% |

The following Table 3 indicates pressures and pressure losses when the flow switching section is provided and when it is not provided in the embodiment illustrated in FIG. 2. As indicated in Table 3, there is no difference of inlet pressure, outlet pressure, and pressure loss on the basis of the main duct between when the flow switching section is provided and when it is not provided.

TABLE 3

Pressure loss according to whether or not the flow switching section is provided

| | Flow switching section being not provided | Flow switching section being provided in the embodiment |
|---|---|---|
| Inlet pressure (Pa) | −3672 | −3671 |
| Outlet pressure (Pa) | −3884 | −3884 |
| Pressure loss (Pa) | −211 | −213 |
| Pressure loss (Pa) in flow switching section | −2 | −4 |

As described above, the apparatus for collecting large particles in a thermal power plant according to the embodiments can effectively reduce toxic ingredients in exhaust gas discharged to the atmosphere by an increase in efficiency for collecting large particles generated during combustion in the thermal power plant. In addition, since the apparatus for collecting large particles in a thermal power plant removes large particles through the hopper before the electrostatic precipitator, the efficiency of the electrostatic precipitator can be increased or the electrostatic precipitator can be replaced.

Hereinafter, an apparatus for collecting large particle ash according to a second embodiment will be described in detail with reference to FIGS. 13 to 23.

Figure 13:
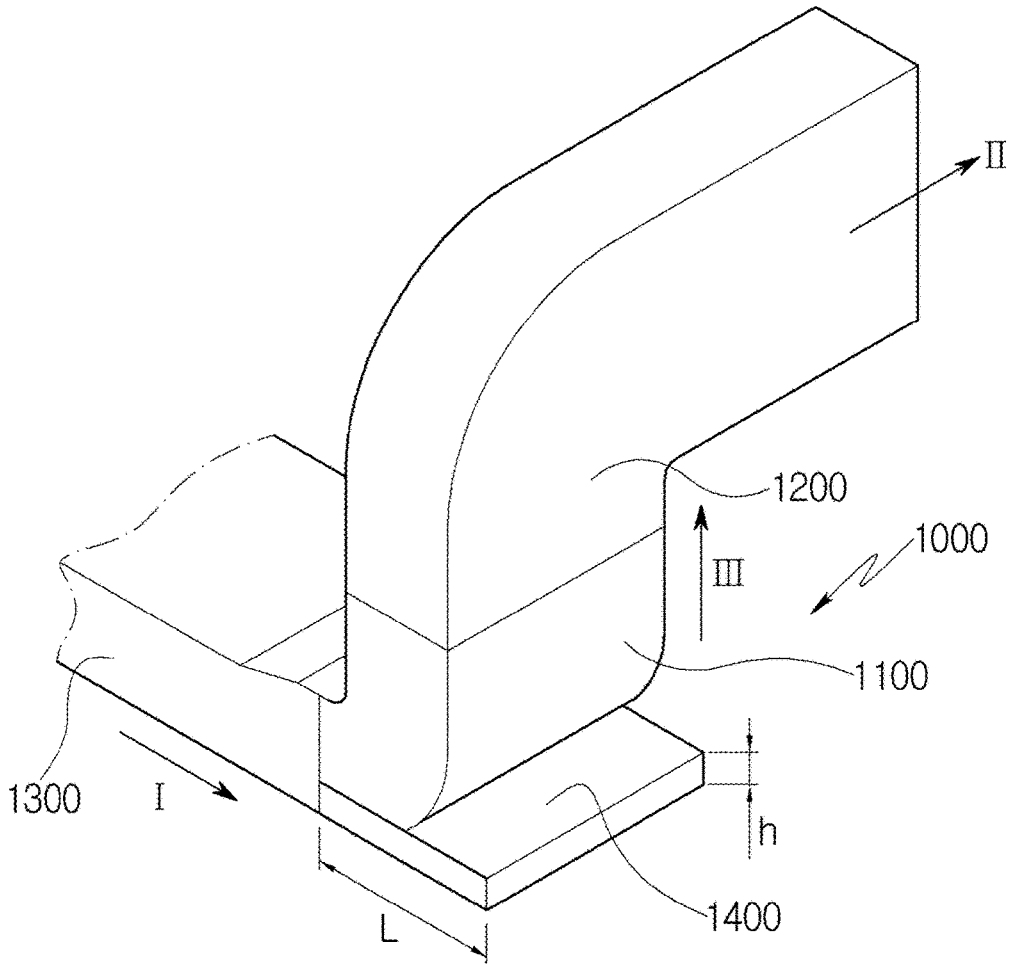
FIG. 13 is a view schematically illustrating an apparatus for collecting large particle ash according to a second embodiment.

Referring to FIG. 13, the apparatus for collecting large particle ash, which is designated by reference numeral 1000, according to the second embodiment is provided to collect large particles (large particle ash) generated during combustion in a thermal power plant. The apparatus for collecting large particle ash 1000 includes a first duct 1300, a second duct 1200, a connection duct 1100, and a side hopper 1400.

In the embodiment, the first duct 1300 may have a quadrangular cross-section, and extends in a first direction. One end of the first duct 1300 may be connected to a gas-air preheater, or may be connected to the main duct 110 of the first embodiment. The other end of the first duct 1300 is connected to the connection duct 1100. Combustion gas burned in the boiler of the thermal power plant is introduced into the first duct 1300 via a selective catalytic Nox reduction system (SCR), and is then discharged to the second duct 1200 via the connection duct 1100.

The second duct 1200 may have a quadrangular cross-section, and extends in a second direction as a whole. The first and second directions are different from each other, and are almost vertical in the illustrated embodiment. In the illustrated embodiment, one end of the second duct 1200 is connected to the connection duct 1100, and the other end of the second duct 1200 is connected to a gas-gas heater (GGH). As illustrated in the drawing, one end of the second duct 1200 connected to the connection duct 1100 is formed with a bent portion which is bent vertically. In other words, the second duct 1200 connected to the connection duct 1100 has the bent portion which is bent to the second direction from a third direction. In the embodiment, the third direction is almost perpendicular to the second direction.

The connection duct 1100 is installed between the first and second ducts 1300 and 1200, and both ends thereof are respectively connected to the first and second ducts 1300 and 1200. In the embodiment, the connection duct 1100 has a quadrangular cross-section, and a bent shape that is switched from the first direction to the third direction.

The side hopper 1400 is installed to the connection duct 1100, and is provided to collect large particles contained in the combustion gas flowing toward the second duct 1200 from the first duct 1300.

Hereinafter, the shape of the side hopper 1400 will be described in detail.

Figure 14:
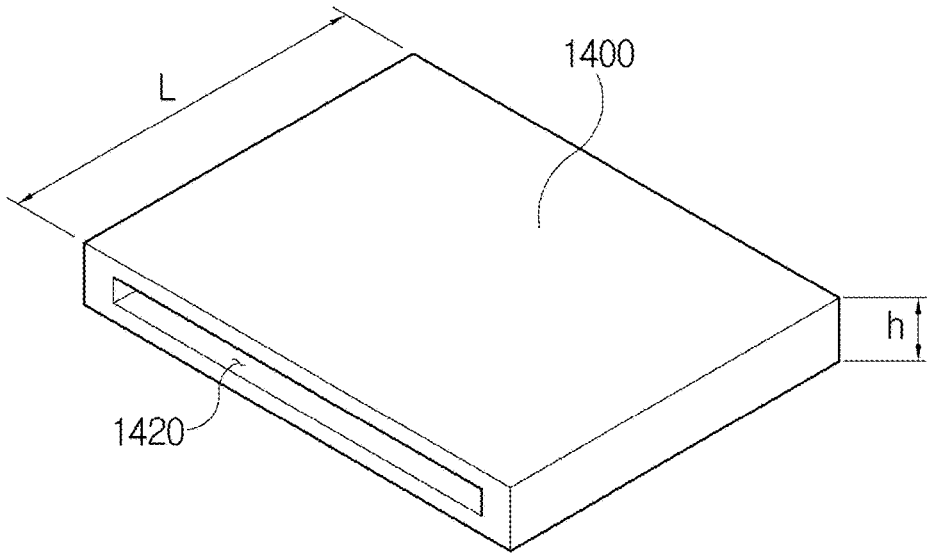
FIG. 14 is an enlarged view schematically illustrating a side hopper in FIG. 13.

Referring to FIGS. 13 and 14, the side hopper 1400 has a quadrangular box shape in the illustrated embodiment. The side hopper 1400 includes an opening portion 1420 communicating with the first duct 1300, and has a predetermined height (h). The side hopper 1400 has a box shape that extends in the first direction from the first duct 1300, and has the opening portion 1420 formed at a connection portion with the first duct 1300 such that the large particles may be introduced through the opening portion 1420. The height (h) of the side hopper 1400 may be set such that a significant amount of large particles is introduced into the side hopper 1400 according to the shapes and extension directions of the first and second ducts 1300 and 1200 and the flow rate of the introduced combustion gas. In the embodiment, the height (h) of the side hopper 1400 may be 1 m.

As the size of large particles contained in the combustion gas introduced into the first duct 1300 is increased, the large particles may be biased toward the bottom of the first duct 1300 by the inertia and weight of the large particles. When the large particles have a large size, the large particles flowing in the first direction are not switched in the third direction in the connection duct 1100, but remain on the bottom. Through the side hopper 1400 of the embodiment, the large particles introduced into the first duct 1300 may be collected in the side hopper 1400, and thus may prevent the large particles from being deposited in the connection duct 1100 or from eroding a specific portion in the connection duct 1100. Meanwhile, the length (L) of the side hopper 1400 may be set such that a significant amount of large particles is introduced into the side hopper 1400 according to the flow rate of the introduced combustion gas.

Hereinafter, only differences between the embodiment illustrated in FIG. 15 and the embodiment illustrated in FIG. 14 will be described.

Figure 15:
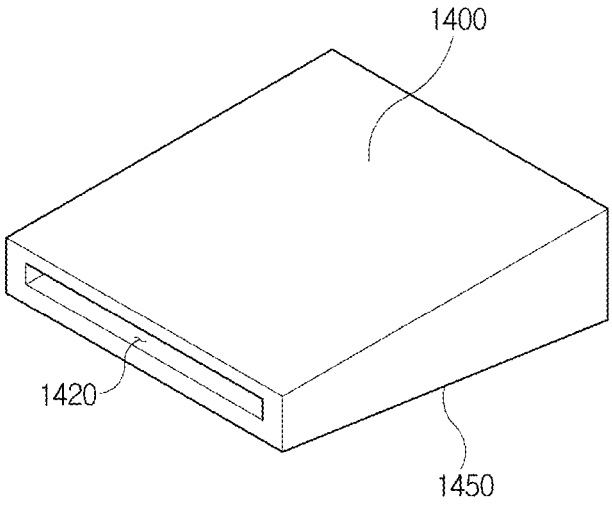
FIGS. 15(*a*) and 15(*b*) are views illustrating another example of a side hopper that is inclined compared to the side hopper illustrated in FIG. 14
Figure 15:
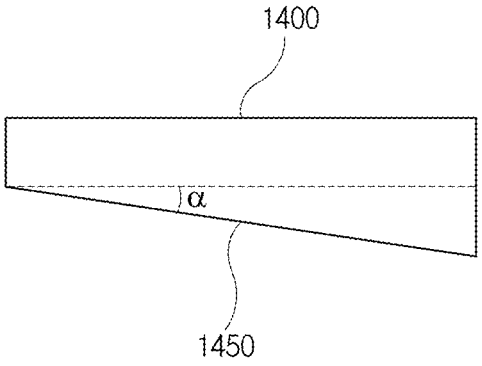

Referring to FIGS. 15(*a*) and 15(*b*), a bottom surface 1450 of a side hopper 1400 is inclined by a predetermined angle (α) so as to be directed further downward on the basis of the first duct 1300, compared to the side hopper illustrated in FIG. 14. Due to the bottom surface 1450 inclined by the predetermined angle (α), the large particles introduced into the side hopper 1400 may be stacked up in turn from the bottom of the side hopper 1400. If the bottom surface 1450 of the side hopper 1400 is not inclined but is parallel with the first duct 1300, the large particles introduced into the side hopper 1400 may be deposited in the vicinity of the opening portion 1420. For this reason, the introduction of the large particles into the side hopper 1400 may be interrupted. In the embodiment, it is possible to prevent the large particles to be deposited in the vicinity of the opening portion 1420 of the side hopper 1400 by the inclined bottom surface 1450, and it is thus possible to improve large particle collection efficiency in the side hopper 1400.

Figure 16:
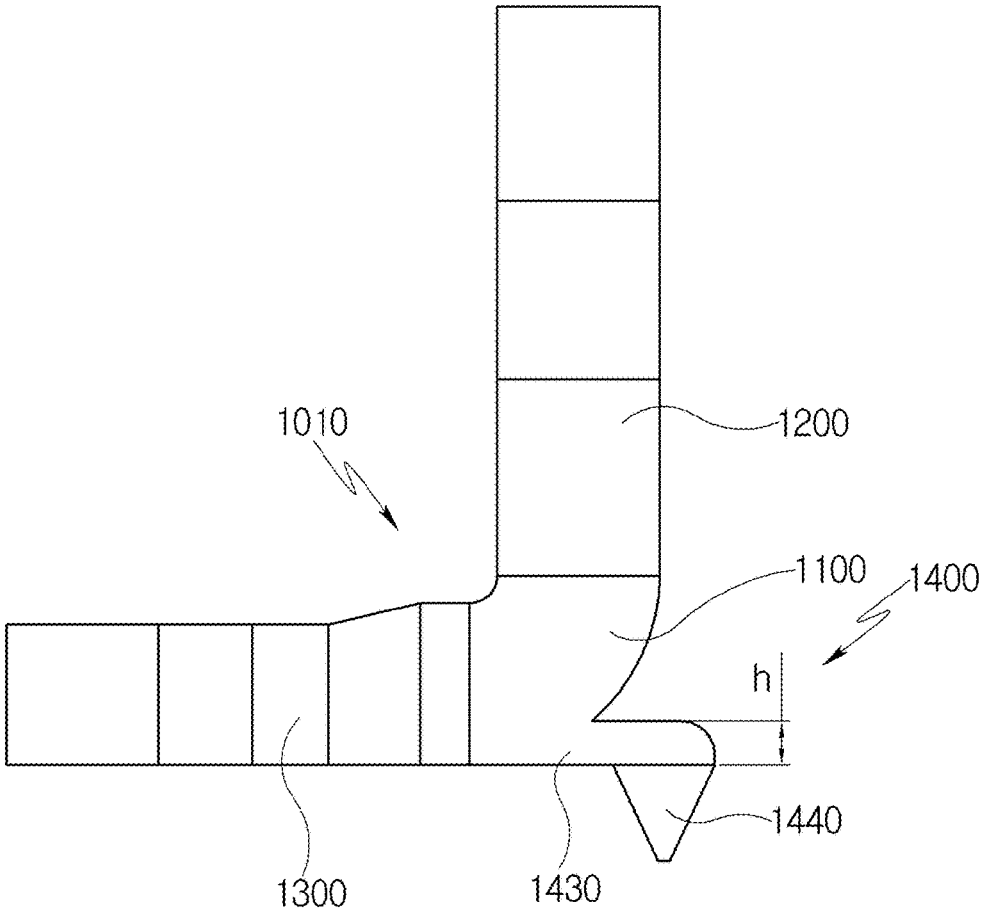
FIG. 16 is a view illustrating another apparatus for collecting large particle ash, in addition to the apparatus in FIG. 13.
Figure 17:
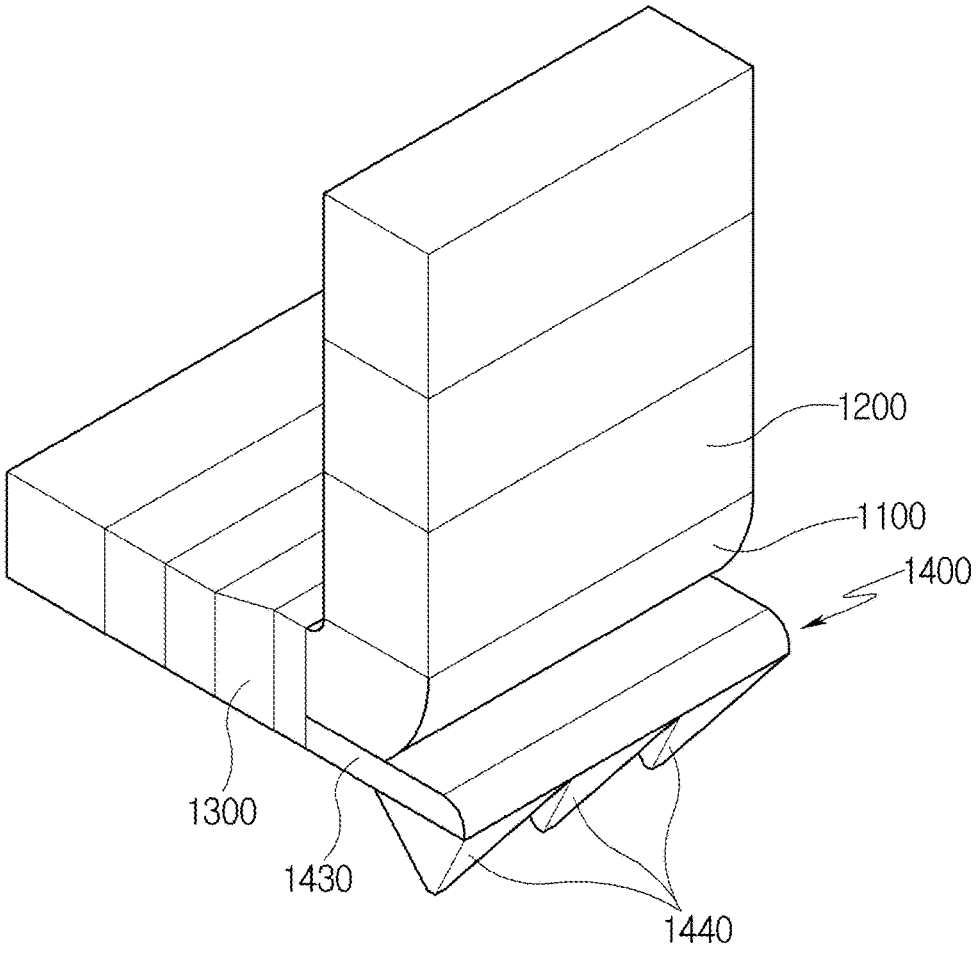
FIG. 17 is a perspective view illustrating the apparatus for collecting large particle ash in FIG. 16.

Referring to FIGS. 16 and 17, an apparatus for collecting large particle ash 1010 illustrated in the drawings is provided to collect large particles (large particle ash) generated during combustion in a thermal power plant. The apparatus for collecting large particle ash 1010 according to the embodiment includes a first duct 1300, a second duct 1200, a connection duct 1100, and a side hopper 1400. The apparatus for collecting large particle ash 1010 is provided, for example, between a gas-air preheater and a gas-gas heater in an overall thermal power plant system. The apparatus for collecting large particle ash 1010 may collect large particles contained in combustion gas when the combustion gas burned in the boiler of the thermal power plant passes between the gas-air preheater and the gas-gas heater.

In the embodiment, the side hopper 1400 includes an extension duct 1430 and a collection section 1440. The extension duct 1430 has a quadrangular box cross-sectional shape. One end of the extension duct 1430 communicates with the first duct 1300, and has a predetermined height (h). The extension duct 1430 has a box shape that extends in the first direction from the first duct 1300, and the height (h) of the extension duct 1430 may be set such that a significant amount of large particles is introduced into the extension duct 1430 according to the shapes and extension directions of the first and second ducts 1300 and 1200 and the flow rate of the introduced combustion gas. In the embodiment, the height (h) of the extension duct 1430 may be 1 m.

The collection section 1440 is provided to collect large particles, and is connected to the right lower end of the extension duct 1430. As illustrated in the drawings, the collection section 1440 may be configured as a plurality of collection sections. Each collection section 1440 has a quadrangular funnel shape. The collection section 1440 collects the large particles contained in the combustion gas introduced through the extension duct 1430, and prevents the large particles from being discharged to the second duct 1200.

Figure 18:
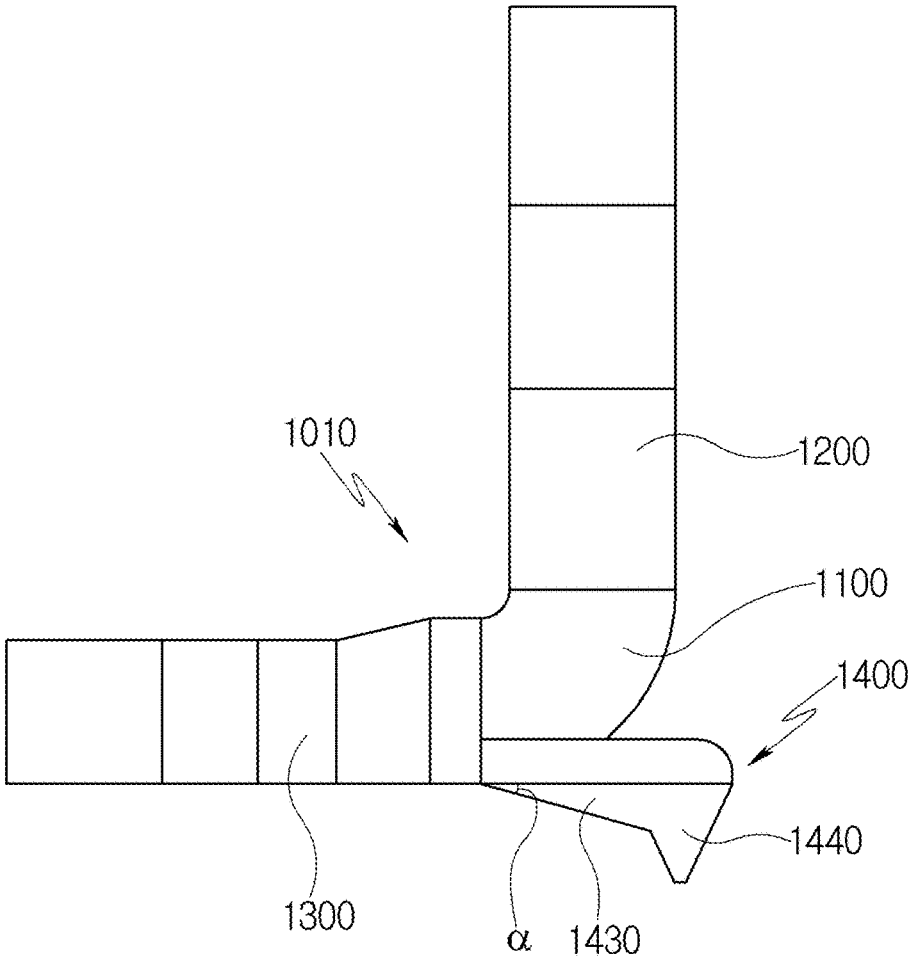
FIG. 18 is a view for explaining another example of an extension duct in FIG. 16.

Meanwhile, the bottom surface of the extension duct 1430 may be inclined by a predetermined angle (α) so as to be directed further downward on the basis of the first duct 1300, as illustrated in FIG. 18. Due to the bottom surface of the extension duct 1430 inclined by the predetermined angle (α), the large particles introduced into the collection section 1440 may be stacked up in turn from the bottom of the collection section 1440. If the bottom surface of the extension duct 1430 is not inclined but is parallel with the first duct 1300, the large particles introduced into the extension duct 1430 may be deposited in the extension duct 1430. For this reason, the introduction of the large particles into the extension duct 1430 may be interrupted. In the embodiment, it is possible to prevent the large particles to be deposited in the extension duct 1430 by the inclined extension duct 1430, and it is thus possible to improve large particle collection efficiency in the collection section 1440.

Figure 19:
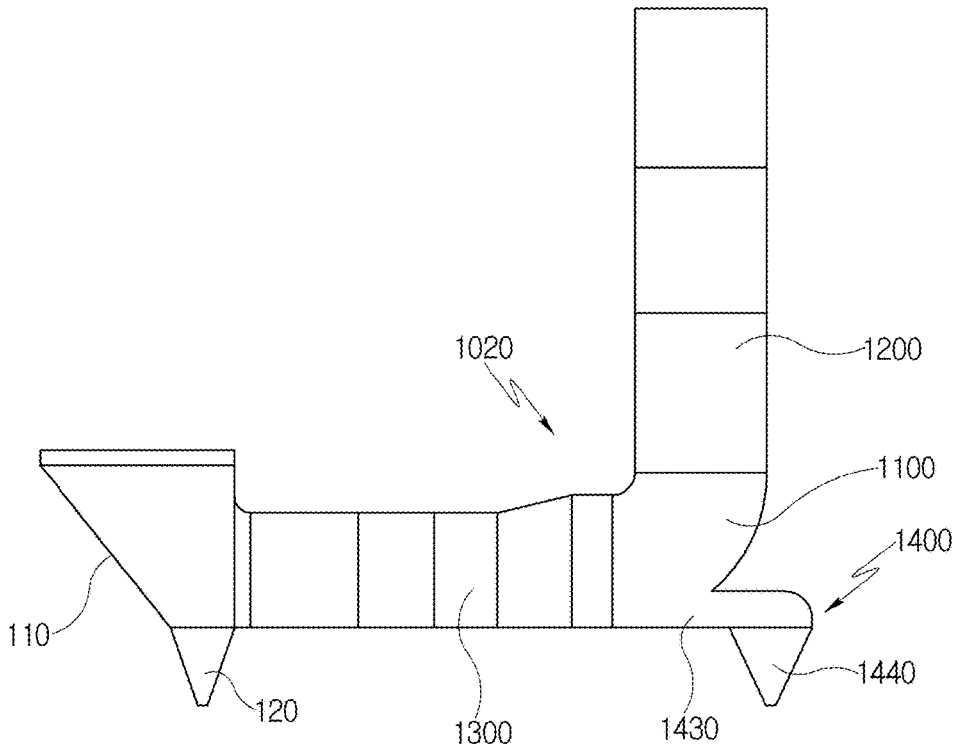
FIG. 19 is a view illustrating a further apparatus for collecting large particle ash, in addition to the apparatus in FIG. 13.

Referring to FIG. 19, an apparatus for collecting large particle ash 1020 illustrated in the drawing is provided to collect large particles (large particle ash) generated during combustion in a thermal power plant. A main duct 110 may be connected in the configuration of the embodiment illustrated in FIG. 17. The main duct 110 is similar to that of the first embodiment including the main hopper 120. The main duct 110 is provided to collect large particles contained in the gas introduced into the first duct 1300, and communicates with the first duct 1300. In the embodiment, the main duct 110 may be installed between the first duct 1300 and the gas-air preheater.

In the embodiment, since the main duct 110 of the first embodiment is used together with the side hopper 1400, it is possible to further improve large particle collection efficiency in the overall thermal power plant system, and to further reduce toxic ingredients in the combustion gas discharged to the atmosphere.

Hereinafter, the effect of the apparatus for collecting large particle ash according to the second embodiment will be described with reference to FIGS. 20 to 23.

Figure 20:
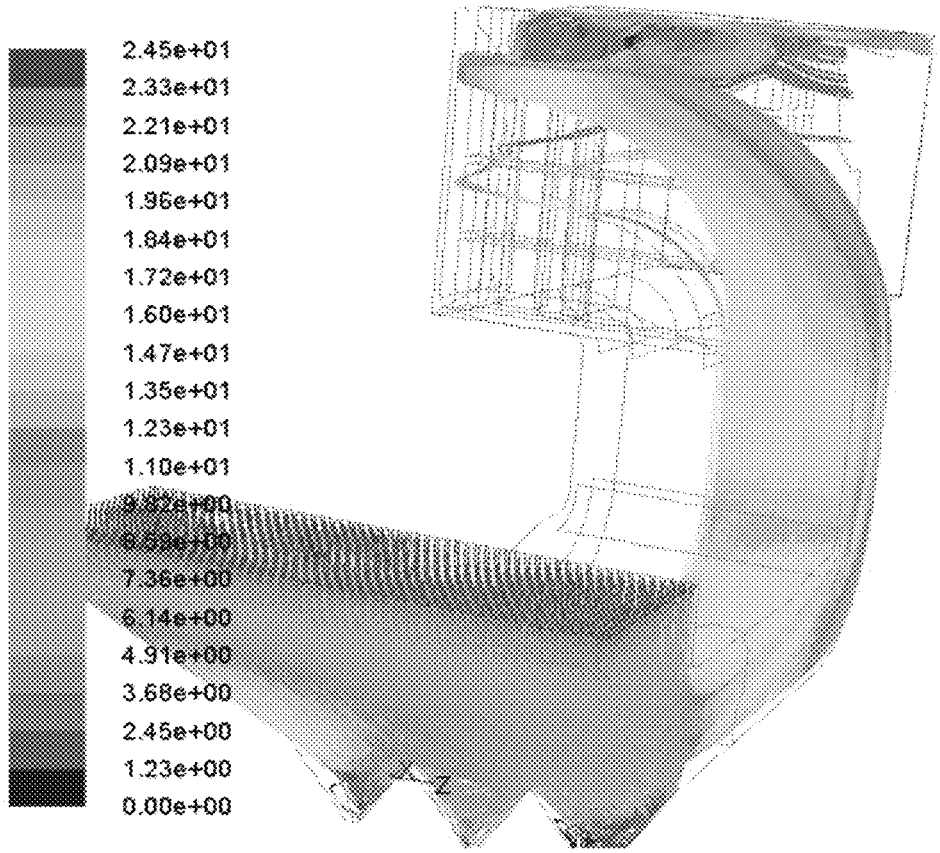
FIG. 20 is a diagram illustrating the flow path of large particles when the side hopper is not included in the apparatuses for collecting large particle ash.

Referring to FIG. 20, large particles having a large size of about 120 μm are biased only toward the right of the duct by inertia, and are biased only upward by one rotation. In addition, the large particles are biased only toward the upper end of the gas-gas heater installed behind the duct. This is because the particles are struck at a speed of 6 m/s to 8 m/s while being not decreased to the speed of exhaust gas. Such a phenomenon occurs because the large particles are not sufficiently decelerated due to the short length of a tube enlarged to the gas-gas heater compared to a case where a relaxation time for large particles is long. As a result, the fin tube of the upper end of the gas-gas heater may be eroded. Here, the relaxation time may be calculated by the following Equation 1:

$$\tau = \frac{\rho_p d^2 C}{18\eta} \quad \text{[Equation 1]}$$

where $\rho_p$ is a particle density, d is a particle diameter, η is an air viscosity, and C is a Cunningham correction factor (the Cunningham correction factor being 1 in large particles).

The time required to adapt particles to completely changed circumstances is 3 τ, and is indicated by the following Table 1. The time required to adapt particles having a size of 100 mm to variation in flow velocity is about 0.09 seconds.

TABLE 1

| Particle diameter (mm) | 3 × Relaxation time |
|---|---|
| 0.01 | $2.1 \times 10^{-8}$ |
| 0.1 | $2.7 \times 10^{-7}$ |
| 1.0 | $1.0 \times 10^{-5}$ |
| 10.0 | $9.3 \times 10^{-4}$ |
| 100 | $9.1 \times 10^{-2}$ |

Figure 21:
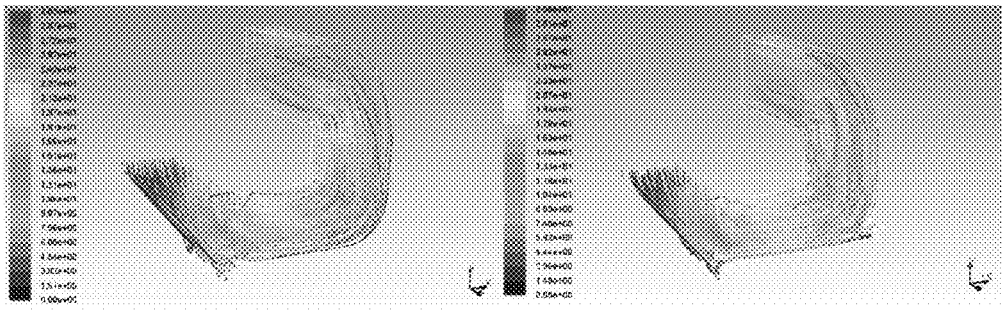
FIG. 21 is a diagram for explaining the trace of particles having a size of 50 μm according to whether or not the apparatus for collecting large particle ash in FIG. 13 is present.
Figure 22:
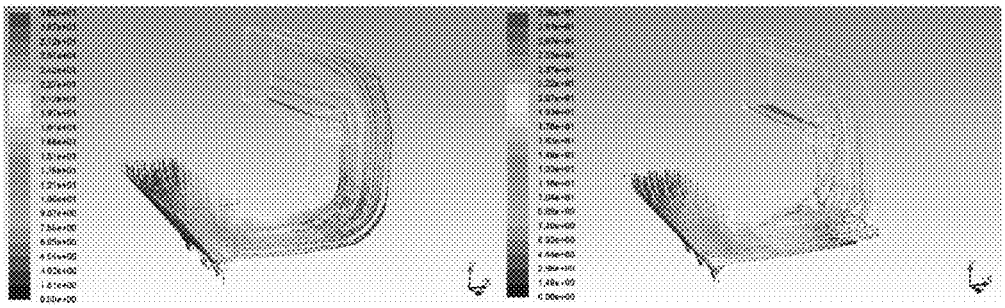
FIG. 22 is a diagram for explaining the trace of particles having a size of 100 μm according to whether or not the apparatus for collecting large particle ash in FIG. 13 is present.
Figure 23:
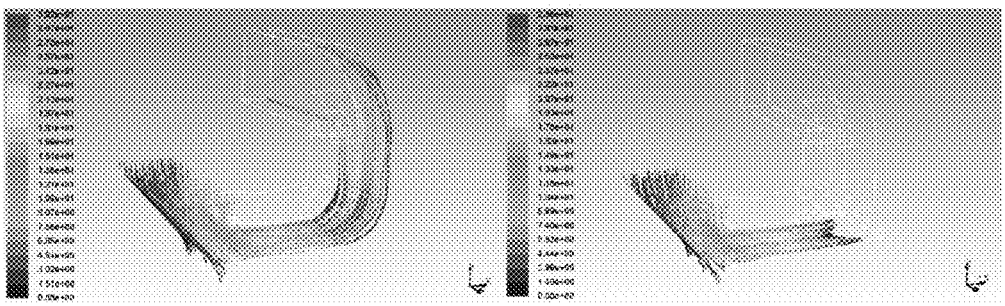
FIG. 23 is a diagram for explaining the trace of particles having a size of 150 μm according to whether or not the apparatus for collecting large particle ash in FIG. 13 is present.

FIGS. 21 to 23 illustrate the comparison of the behavior and removal amount of particles having a size of 50 μm in the hopper according to whether or not the side hopper is installed. The drawings illustrate the comparison of large particles having a size of 50 μm to 150 μm. In the drawings, the left is a case where the side hopper is not provided, and the right is a case where the side hopper is provided.

There does not appear to be a significant difference of a large particle removal ratio in the large particles having a size of 50 μm, and the large particle removal ratio is increased by about 8%. It may be seen that large particles, having a size of 100 μm, introduced into the gas-gas heater (GGH) is significantly reduced, and the large particle removal ratio is increased by about 37%. It may be seen that large particles having a size of 150 μm do not reach the gas-gas heater when the side hopper is installed, and are perfectly removed from the side hopper. That is, as particles have a large size that primarily causes the erosion of the gas-gas heater, the removal amount of the particles is increased. That is, it may be seen that particles, which are not removed from the main hopper, are introduced into and removed from the side hopper.

The following Table 2 indicates the removal amount of large particles according to large particles and whether or not the side hopper is installed. As indicated in Table 2, it may be seen that, when the side hopper is installed, the large particle removal amount is increased more than 1.5 times. In particular, it is seen that the large particles having a size of 150 μm may be perfectly (100%) removed by the installation of the side hopper.

TABLE 2

| | Removal amount | |
|---|---|---|
| | Side hopper being not present | Side hopper being present |
| 150 μm | 62% | 100% |
| 100 μm | 45% | 82% |
| 50 μm | 15% | 23% |

The following Table 3 indicates the comparison between a removal ratio in the main hopper and a removal ratio in the side hopper according to the height (h) of the side hopper. As indicated in Table 3, it may be seen that there is no difference of removal ratio in the main hopper even though the height (h) of the side hopper is varied. On the other hand, the removal ratio in the side hopper is significantly varied according to the height (h) of the side hopper. As indicated in Table 3, the large particle removal ratio is highest when the height (h) of the side hopper is 1.5 m, and the large particle removal ratio is secondarily high when the height (h) of the side hopper is 1 m. However, when the height (h) of the side hopper is 1.5 m, a pressure loss due to the side hopper is significantly increased. Therefore, the height (h) of the side hopper is most preferably 1 m when both of the pressure loss and the large particle removal ratio are considered.

TABLE 3

| Height | Particle size | Removal ratio in main hopper | Removal ratio in side hopper | Total removal ratio | Pressure loss |
|---|---|---|---|---|---|
| 0.75 m | 150 μm | 65% | 34% | 99% | 37.91 Pa |
| | 100 μm | 44% | 24% | 68% | |
| | 50 μm | 16% | 4% | 21% | |
| 1 m | 150 μm | 65% | 35% | 100% | 46.92 Pa |
| | 100 μm | 45% | 37% | 82% | |
| | 50 μm | 15% | 8% | 23% | |
| 1.25 m | 150 μm | 62% | 37% | 99% | 42.36 Pa |
| | 100 μm | 44% | 32% | 76% | |
| | 50 μm | 14% | 4% | 19% | |
| 1.5 m | 150 μm | 62% | 38% | 100% | 103.14 Pa |
| | 100 μm | 44% | 47% | 91% | |
| | 50 μm | 15% | 14% | 29% | |

As described above, the apparatus for collecting large particles in a thermal power plant according to the embodiments can effectively reduce toxic ingredients in exhaust gas discharged to the atmosphere by an increase in efficiency for collecting large particles (large particle ash) generated during combustion in the thermal power plant. In addition, since the apparatus for collecting large particles in a thermal power plant according to the embodiments removes large particles (large particle ash) through the hopper before the electrostatic precipitator, the efficiency of the electrostatic precipitator can be increased or the electrostatic precipitator can be replaced. In addition, since the hopper is installed at the portion of the exhaust duct in which the direction thereof is switched, it is possible to prevent the large particles from eroding the specific portion in the duct and from being deposited in the duct.

As is apparent from the above description, an apparatus for collecting large particles in a thermal power plant according to exemplary embodiments can effectively reduce toxic ingredients in exhaust gas discharged to the atmosphere by an increase in efficiency for collecting large particles (large particle ash) generated during combustion in a thermal power plant.

In addition, since the apparatus removes large particles (large particle ash) through a hopper before an electrostatic precipitator (ESP), the efficiency of the electrostatic precipitator can be increased or the electrostatic precipitator can be replaced.

Although embodiments have been described with reference to a number of illustrative embodiments thereof, it should be understood that numerous other modifications and applications may be devised by those skilled in the art that will fall within the intrinsic aspects of the embodiments. More particularly, various variations and modifications are possible in concrete constituent elements of the embodiments.

In addition, it is to be understood that differences relevant to the variations and modifications fall within the spirit and scope of the present disclosure defined in the appended claims.

What is claimed is:

1. An apparatus for collecting large particle ash generated during combustion in a thermal power plant, the apparatus comprising:

a first duct extending in a first direction;

a second duct extending in a second direction different from the first direction;

a connection duct installed between the first and second ducts and configured to communicate with each of an outlet of the first duct and an inlet of the second duct; and a side hopper having an opening portion communicating with the outlet of the first duct to collect large particle ash contained in gas flowing from the first duct to the second duct, wherein the connection duct includes a lower portion communicating with the outlet of the first duct, and an upper portion communicating with the inlet of the second duct and extending from the lower portion in a third direction perpendicular to each of the first and second directions; and wherein the side hopper has a top surface installed on a lower side of the lower portion and is disposed in a direction opposite to the third direction.

2. The apparatus according to claim 1, wherein the connection duct has a shape that is bent from the first direction to the second direction.

3. The apparatus according to claim 1, wherein the side hopper extends from the first duct in the first direction.

4. The apparatus according to claim 3, wherein the side hopper comprises:

an extension duct communicating with the first duct; and a collection section connected to the extension duct and having a funnel shape.

5. The apparatus according to claim 4, wherein the extension duct has an inclined lower portion in order to increase large particle ash collection efficiency.

6. The apparatus according to claim 5, wherein the extension duct has a height of 1 m.

7. The apparatus according to claim 1, wherein the side hopper includes a bottom surface that is disposed opposite to the top surface and is inclined at a predetermined angle with respect to the first direction, and an end surface that is disposed opposite to the opening portion and connects the top and bottom surfaces; and wherein the side hopper has a box shape such that a plane of the opening portion is parallel to the end surface.

* * * * *